US008375509B2

(12) United States Patent
Bates et al.

(10) Patent No.: US 8,375,509 B2
(45) Date of Patent: Feb. 19, 2013

(54) CYCLONIC SEPARATING APPARATUS FOR A CLEANING APPLIANCE

(75) Inventors: Adam James Bates, Malmesbury (GB); Timothy Nicholas Stickney, Malmesbury (GB)

(73) Assignee: Dyson Technology Limited, Malmesbury (GB)

( * ) Notice: Subject to any disclaimer, the term of this patent is extended or adjusted under 35 U.S.C. 154(b) by 939 days.

(21) Appl. No.: 12/243,586

(22) Filed: Oct. 1, 2008

(65) Prior Publication Data

US 2009/0100634 A1 Apr. 23, 2009

(30) Foreign Application Priority Data

Oct. 18, 2007 (GB) ..... 0720340.9

(51) Int. Cl.
*A47L 9/16* (2006.01)
*B01D 45/12* (2006.01)

(52) U.S. Cl. ..... 15/353; 55/343; 55/349; 55/433; 55/DIG. 3

(58) Field of Classification Search ..... 15/352; 55/343, 346, 349, 432, 433, 429, 459.1, DIG. 3; *A47L 9/16; B01D 45/12*
See application file for complete search history.

(56) References Cited

U.S. PATENT DOCUMENTS

| | | | |
|---|---|---|---|
| 3,486,618 | A | 12/1969 | Wikdahl |
| 4,687,497 | A | 8/1987 | Owen et al. |
| 5,000,767 | A | 3/1991 | Sanders et al. |
| 6,607,572 | B2 | 8/2003 | Gammack et al. |
| 6,835,222 | B2 | 12/2004 | Gammack |
| 7,867,307 | B2 | 1/2011 | Bates et al. |

FOREIGN PATENT DOCUMENTS

| | | |
|---|---|---|
| EP | 0 042 723 | 12/1981 |
| EP | 1 023 864 | 8/2000 |
| EP | 1 268 076 | 1/2003 |
| EP | 1 370 172 | 12/2003 |
| EP | 1 370 173 | 12/2003 |
| EP | 1707273 | 10/2006 |
| EP | 1774890 | 4/2007 |
| GB | 2360719 | 10/2001 |
| GB | 2374032 | 10/2002 |
| GB | 2 386 827 | 10/2003 |
| GB | 2 441 300 | 3/2008 |
| JP | 2002-326041 | 11/2002 |

(Continued)

OTHER PUBLICATIONS

GB Search Report dated Feb. 12, 2008 directed towards counterpart application No. GB0720340.9; 1 page.

(Continued)

*Primary Examiner* — David Redding
(74) *Attorney, Agent, or Firm* — Morrison & Foerster LLP

(57) ABSTRACT

A cyclonic separating apparatus for a cleaning appliance includes a plurality of cyclonic separators arranged in series for separating particles from a dirt- and dust-laden airflow, at least three collectors for collecting separated dirt and dust, and a closure member movable between a closed position in which the closure member closes an end of each collector and an open position in which separated dirt and dust can be emptied from the collectors. The ends of the collectors are separated by dividing walls. A seal is provided to seal between the closure member and the dividing walls when the closure member is in the closed position. This common seal between the dividing walls and the closure member is able to seal effectively even if the closure member is misaligned or incorrectly fitted.

14 Claims, 5 Drawing Sheets

FOREIGN PATENT DOCUMENTS

| | | | |
|---|---|---|---|
| JP | 2003-156002 | | 5/2003 |
| JP | 2003-528704 | | 9/2003 |
| JP | 2004-520137 | | 7/2004 |
| JP | 2004-229827 | | 8/2004 |
| KR | 10-2007-0012988 | | 1/2007 |
| WO | WO-02/067742 | | 9/2002 |
| WO | WO-02/067752 | | 9/2002 |
| WO | WO-2006/125944 | A1 | 11/2006 |
| WO | WO-2006/125945 | | 11/2006 |

OTHER PUBLICATIONS

International Search Report and Written Opinion mailed on Jan. 1, 2009 directed towards international application No. PCT/GB2008/003387; 13 pages.

Bates et al., U.S. Office Action mailed Aug. 19, 2010, directed to U.S. Appl. No. 12/243,484; 7 pages.

CYCLONIC SEPARATING APPARATUS FOR A CLEANING APPLIANCE

REFERENCE TO RELATED APPLICATIONS

This application claims the priority of United Kingdom Application No. 0720340.9, filed Oct. 18, 2007, the contents of which are incorporated herein by reference.

FIELD OF THE INVENTION

The present invention relates to cyclonic separating apparatus for a cleaning appliance. Particularly, but not exclusively, the present invention relates to cyclonic separating apparatus for a vacuum cleaner.

BACKGROUND OF THE INVENTION

Vacuum cleaners which utilise cyclonic separating apparatus are well known. Examples of such vacuum cleaners are shown in EP 0 042 723, EP 1 370 173 and EP 1 268 076. In general, an airflow in which dirt and dust is entrained enters a first cyclonic separator via a tangential inlet which causes the airflow to follow a spiral or helical path within the first cyclonic separator so that the dirt and dust is separated from the airflow. Relatively clean air passes out of the chamber while the separated dirt and dust is collected in a first collector. In some applications, and as described in EP 0 042 723, the airflow is then passed to a second cyclonic separator which is capable of separating finer dirt and dust than the first cyclonic separator. The cleaned airflow then exits the cyclonic separating apparatus, and the separated fine dirt and dust is collected in a second collector.

The absence of a bag in a cyclonic vacuum cleaner can create difficulties for the disposal of the dirt and dust which is collected by the cleaner. When the collectors of a vacuum cleaner such as that described in EP 0 042 723 become full, a user typically removes the cyclonic separating apparatus from the main body of the machine and tips the collectors upside down. Often it may be necessary for the user to dislodge the dirt manually, which can be inconvenient.

An improved arrangement is disclosed in EP 1 023 864, which describes a vacuum cleaner with separating apparatus which can be removed from a main body of the cleaner for emptying. A lower closure of the separating apparatus is attached by way of a hinge to the remainder of the separating apparatus and the closure can be released by pressing a release button. Although it is desirable to provide a separating apparatus which can be emptied in this way, it can be difficult to seal the lower closure reliably against the remainder of the separating apparatus.

An improved sealing arrangement is described in EP 1 370 172. The described vacuum cleaner has a first and a second cyclonic separator, each having a separate collector. The collectors are annular and the first collector surrounds the second collector. Attached to the lower end of an annular wall separating the two collectors is a depending annular seal. A hinged closure member is connected to the base of the first collector and which can be released to empty the two collectors. When the closure member is moved to a closed position, the seal is wiped against a part of the closure member, ensuring that the sealing surface is clear of dirt and dust, and allowing the seal to be stretched slightly by engagement with the closure member when in the closed position. This helps to maintain the sealing action.

An alternative sealing arrangement is used on a range of vacuum cleaners sold by Dyson™ under the trade name DC12™. These vacuum cleaner also have two cyclonic separators, each having a separate collector. In this arrangement, a hinged closure member carries a small annular seal which seals against a wall separating the two collectors.

However, a problem associated with both of the above arrangements is that the seal may become less effective with use; for example, the seal may become worn or brittle and may not seal correctly. Also, with an arrangement using a movable closure member, there is a risk that the user may not return the closure member to the correct closed position after emptying the collectors. The above situations may lead to ineffective sealing between the collectors and leaks occurring therebetween. This is undesirable because separated dirt and dust can move between the collectors and may become re-entrained in the airflow, reducing the efficiency at which the cyclonic separating apparatus operates. Leaks between collectors may also lead to unwanted pressure drops, again reducing the efficiency at which the cyclonic separating apparatus operates.

Some, more recent, vacuum cleaners include cyclonic separating apparatus which has more than two cyclonic separators or separation stages. Cyclonic separating apparatus including three cyclonic separators is disclosed in WO 2006/125944, in which, three collectors are required—one for each cyclonic separator. Clearly, the greater the number of collectors which are provided, the greater is the risk of leaks occurring between these collectors if they are not sealed correctly.

SUMMARY OF THE INVENTION

It is an object of the present invention to improve the sealing of a closure member to the remainder of the cyclonic separating apparatus. It is a further object of the invention to provide a seal which is able to seal efficiently more than two collectors.

According to the invention, there is provided cyclonic separating apparatus for a cleaning appliance, the cyclonic separating apparatus comprising a plurality of cyclonic separators arranged in series for separating particles from a dirt- and dust-laden airflow, at least three collectors for collecting the separated dirt and dust, and a closure member movable between a closed position in which the closure member closes an end of each collector and an open position in which separated dirt and dust can be emptied from the collectors, the ends of the collectors being separated by dividing walls, wherein a seal is provided to seal between the closure member and the dividing walls when the closure member is in the closed position.

By providing a common seal which seals between the dividing walls and the closure member, the seal is able to seal effectively even if the closure member is misaligned or incorrectly fitted. This is because the seal has a larger area over which sealing can take place when compared to an arrangement of individual seals between each dividing wall and the closure member. Further, only a single seal is required, which reduces manufacturing tolerances and costs.

Preferably, the seal is annular. By providing an annular seal, the seal is able to seal between at least three collectors with the minimum of excess material. This reduces the cost of manufacture.

Alternatively, the seal is in the form of a sheet. By providing a seal in the form of a sheet, a seal can be simply and reliably fitted to the cyclonic separating apparatus, reducing manufacturing costs.

BRIEF DESCRIPTION OF THE DRAWINGS

An embodiment of the invention will now be described with reference to the accompanying drawings, in which.

DETAILED DESCRIPTION OF THE INVENTION

Figure 1:
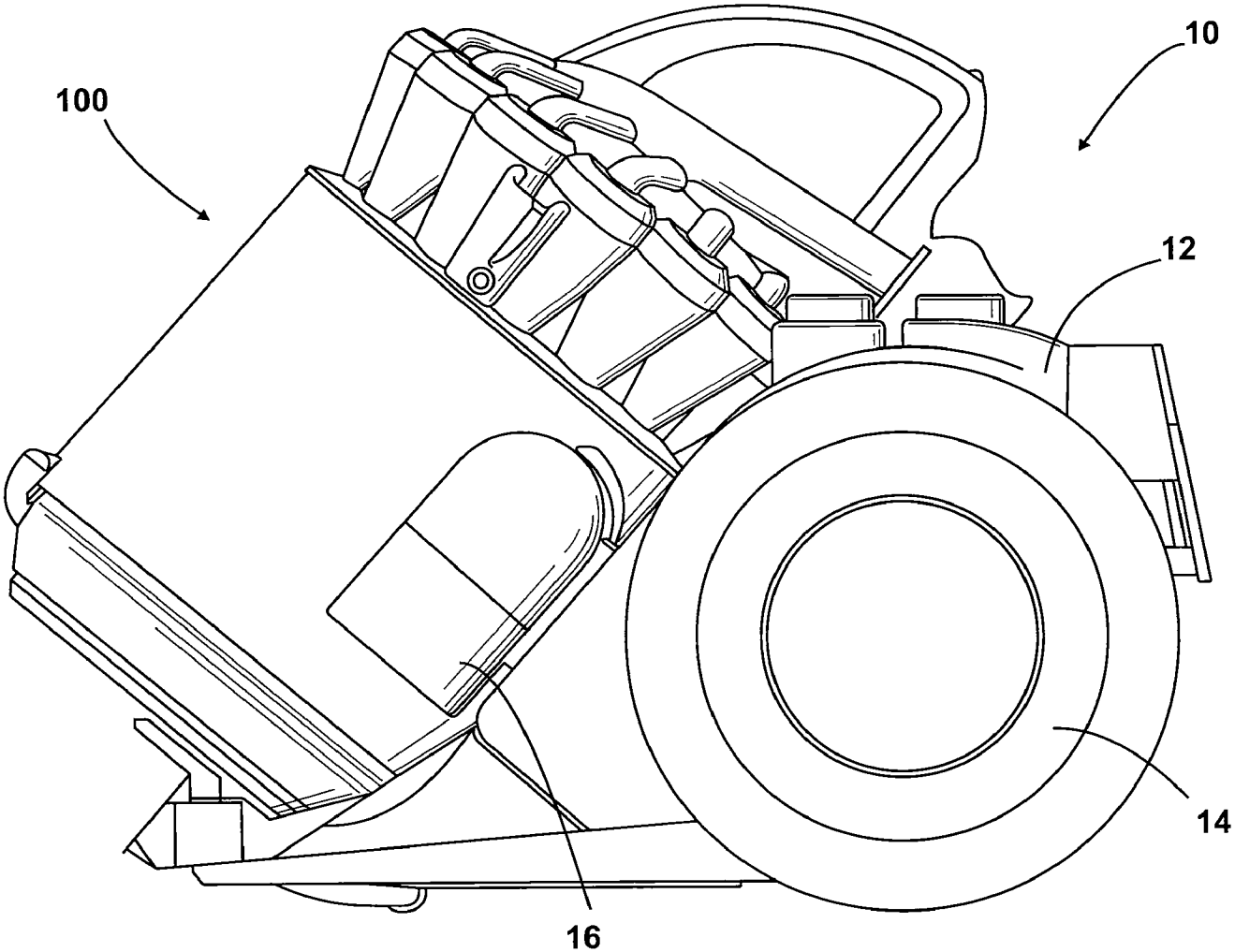
FIG. 1 is a side view of a cylinder vacuum cleaner including cyclonic separating apparatus according to the invention.
Figure 2:
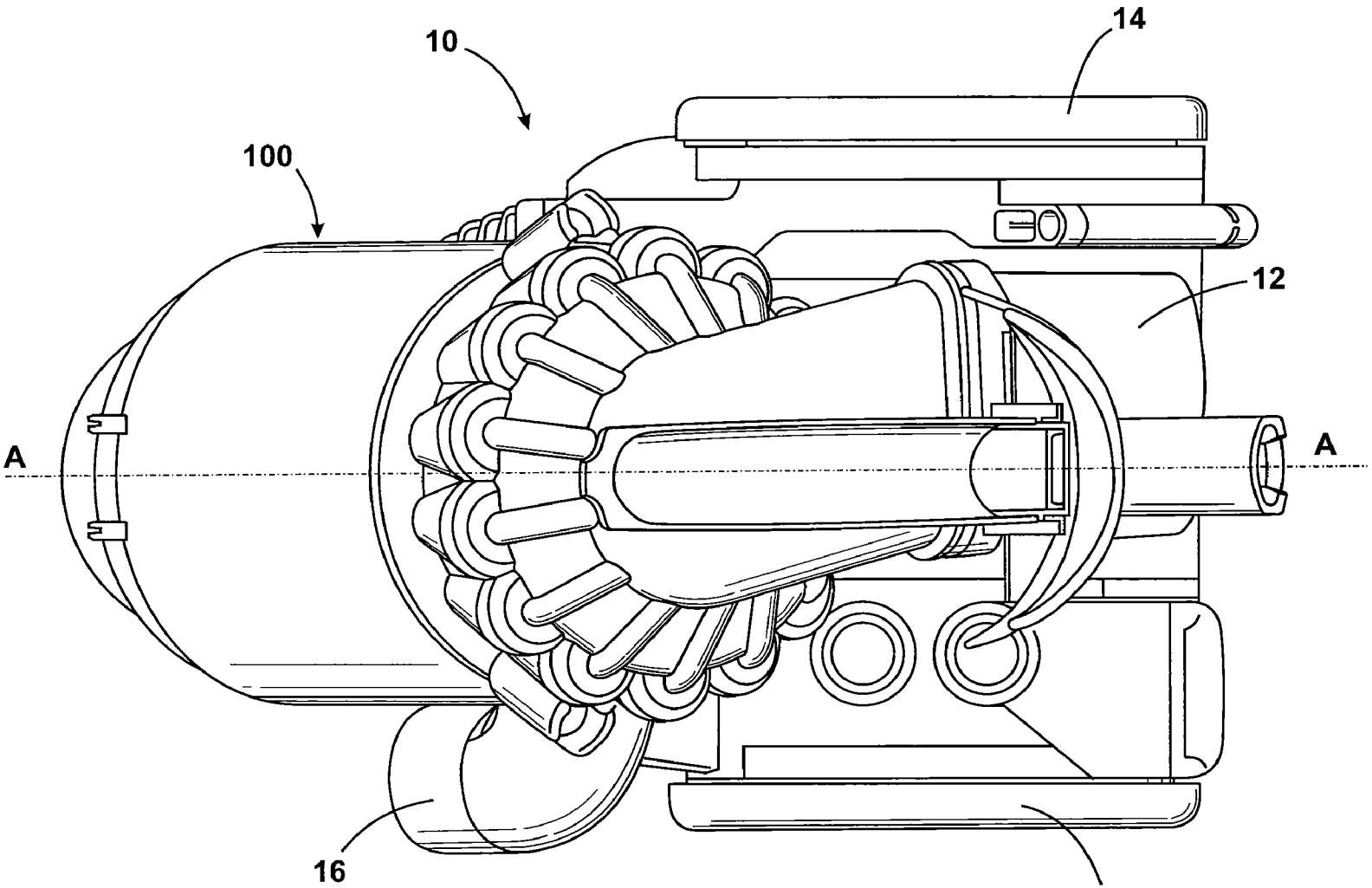
FIG. 2 is a plan view of the cylinder vacuum cleaner of FIG. 1.

A cylinder vacuum cleaner 10 incorporating cyclonic separating apparatus according to the invention is shown in FIGS. 1 and 2. The vacuum cleaner 10 has a main body 12 housing a motor and fan unit (not shown) and to which a pair of wheels 14 is attached. The wheels 14 allow the main body 12 of the vacuum cleaner 10 to be maneuvered across a floor surface. A dirty air inlet 16 is formed on the main body 12. A hose and wand assembly (not shown) can be connected to the dirty air inlet 16 in order to enable a user to clean a floor surface.

Cyclonic separating apparatus 100 according to the invention is releasably attached to the main body 12. The interior of the cyclonic separating apparatus 100 is in communication with the dirty air inlet 16 through which a dirt-laden airflow enters the cyclonic separating apparatus 100. The cyclonic separating apparatus 100 can be removed from the main body 12 for emptying purposes.

Figure 3:
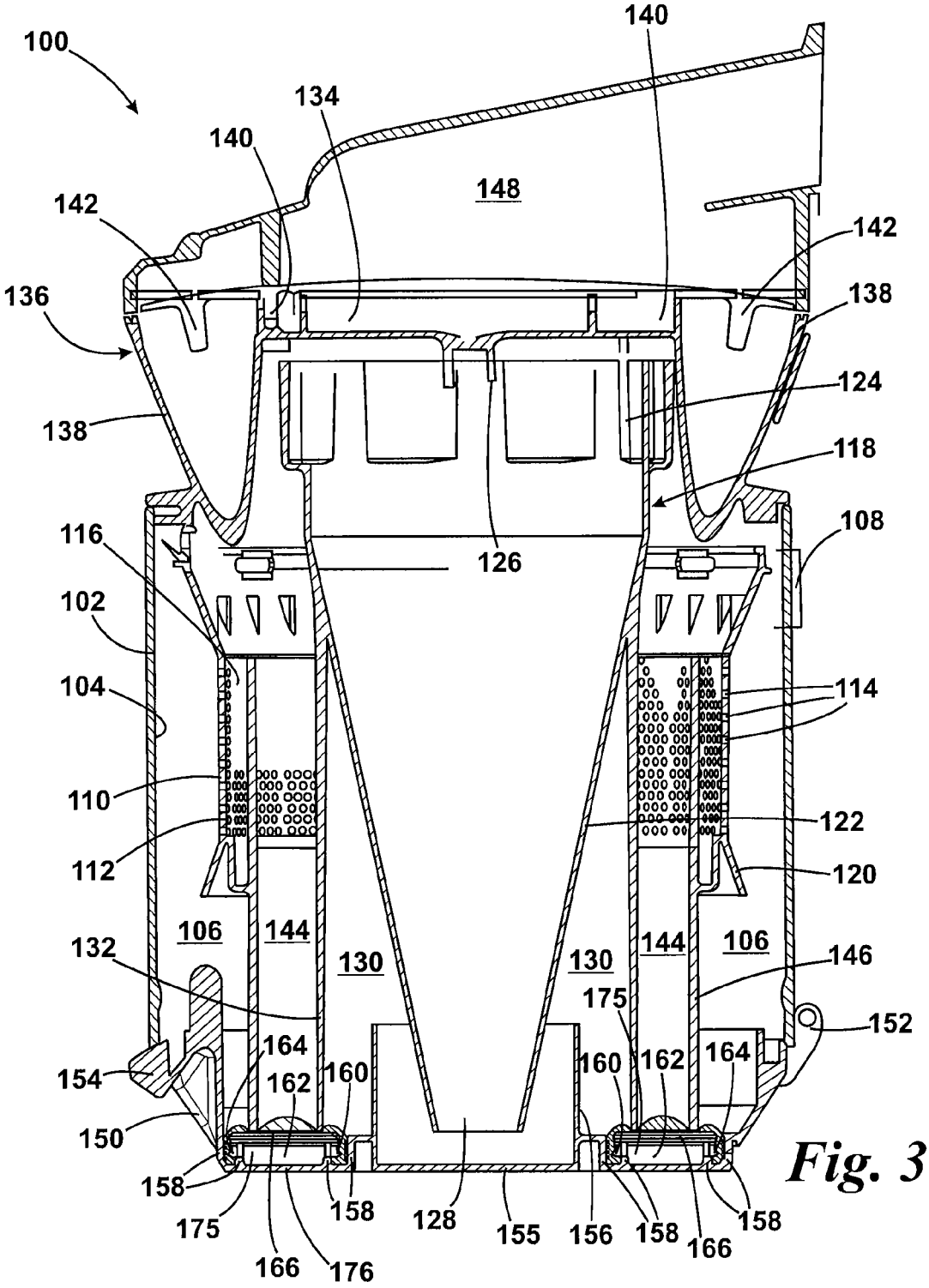
FIG. 3 is a side section taken along the line A-A of FIG. 2 showing the cyclonic separating apparatus removed from the cylinder vacuum cleaner of FIG. 1.

The cyclonic separating apparatus 100 is shown in more detail in FIG. 3, in which the cyclonic separating apparatus 100 is shown removed from the remainder of the vacuum cleaner 10 for clarity. The cyclonic separating apparatus 100 comprises a substantially cylindrical outer wall 102. The outer wall 102 defines a first cyclonic separator 104 and a first collector 106. Dirt and dust is both separated by the first cyclonic separator 104 and collected in the first collector 106 in this region. An inlet 108 is formed in the outer wall 102. The inlet 108 forms a communication path between the dirty air inlet 16 and the interior of the first cyclonic separator 104. The air inlet 108 is arranged tangentially to the first cyclonic separator 104 so that the incoming air is forced to follow a helical path around the interior of the outer wall 102.

A shroud 110 is located inwardly of the outer wall 102 of the first cyclonic separator 104. The shroud 110 comprises a cylindrical wall 112 having a plurality of through-holes 114. The shroud 110 surrounds an outlet 116 from the first cyclonic separator 104. The outlet 116 provides a communication path between the first cyclonic separator 104 and a second cyclonic separator 118. A lip 120 is provided at the base of the shroud 110. The lip 120 helps prevent separated dirt and dust from being re-entrained back into the airflow within the first cyclonic separator 104.

The second cyclonic separator 118 comprises a single cyclone 122. The single cyclone 122 has an air inlet 124 and an air outlet 126, both of which are located at a first end of the single cyclone 122. A cone opening 128 is located at a second end of the single cyclone 122. A second collector 130 is also located at the second end of the single cyclone 122 and is in communication with the cone opening 128. The second collector 130 is delimited by a cylindrical wall 132 which depends from an outer surface of the single cyclone 122 and which is located inwardly of the shroud 110. The air outlet 126 of the single cyclone 122 is in communication with a duct 134. The duct 134 provides a communication path between the second cyclonic separator 118 and a third cyclonic separator 136.

The third cyclonic separator 136 comprises a plurality of high-efficiency cyclones 138 arranged in parallel. In this embodiment, fourteen high-efficiency cyclones 138 are provided. Each high-efficiency cyclone 138 has a tangentially-arranged air inlet 140 and an air outlet 142. Each air inlet 140 and air outlet 142 is located at a first end of the respective high-efficiency cyclone 138. A cone opening (not shown) is located at a second end of each high-efficiency cyclone 138.

A third collector 144 is located at the second end of the high-efficiency cyclones 138 and is in communication with the cone openings of the high-efficiency cyclones 138. The third collector 144 is delimited by the cylindrical wall 132 and a cylindrical wall 146 which is located between the shroud 110 and the cylindrical wall 132. The cylindrical wall 146 depends from an upper part of the shroud 110 and is also connected to the shroud at a point approximately half way down the cylindrical wall 146. Therefore, the third collector 144 is an annular chamber located between the first collector 106 and the second collector 130.

The first, second and third collectors 106, 130, 144 are arranged concentrically. The second and third collectors 130, 144 are arranged inside the first collector 106. The second collector 130 is also arranged inside the third collector 144. The ends of the collectors 106, 130, 144 are separated by dividing walls 132, 146. The ends of the first and third collectors 106, 144 are divided by cylindrical wall 146, and the ends of the second and third collectors 130, 144 are divided by cylindrical wall 132.

The air outlets 142 of the high-efficiency cyclones 138 are in communication with an outlet 148. The outlet 148 provides an airflow path from the cyclonic separating apparatus 100 into other parts of the vacuum cleaner 10. Located downstream of the outlet 148 is a pre-motor filter (not shown), the motor and fan unit and a post-motor filter (not shown).

A closure member 150 closes the lower end of the cyclonic separating apparatus 100. The closure member 150 is pivotably mounted on the lower end of the outer wall 102 by means of a hinge 152. The closure member 150 is retained in a closed position (as shown in FIG. 3) by means of a catch 154. The closure member 150 comprises a base 155 and an inner annular wall 156 extending into the second collector 130. The inner annular wall 156 helps to reduce the risk of dirt and dust separated by the single cyclone 122 of the second cyclonic separator 118 being re-entrained into the airflow leaving the single cyclone 122.

The closure member 150 also includes four further annular walls 158 concentric with and arranged radially outside the inner annular wall 156. Adjacent annular walls 158 delimit three concentric, annular channels 160, 162, 164. The three annular channels 160, 162, 164 comprise a relatively wide channel 162 flanked by two relatively narrow channels 160, 164.

Figure 4:
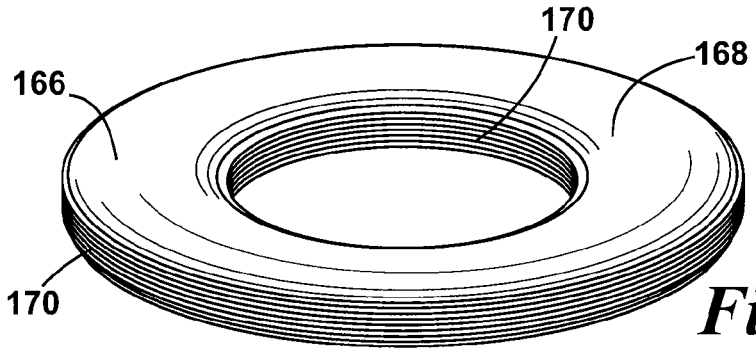
FIG. 4 is perspective view of a seal of the cyclonic separating apparatus of FIG. 3.
Figure 5:
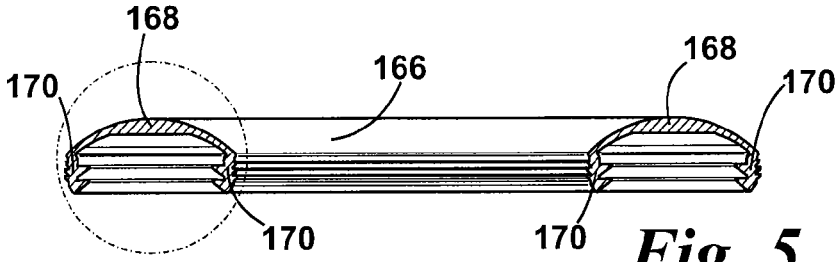
FIG. 5 is a side section of the seal of FIG. 4.
Figure 6:
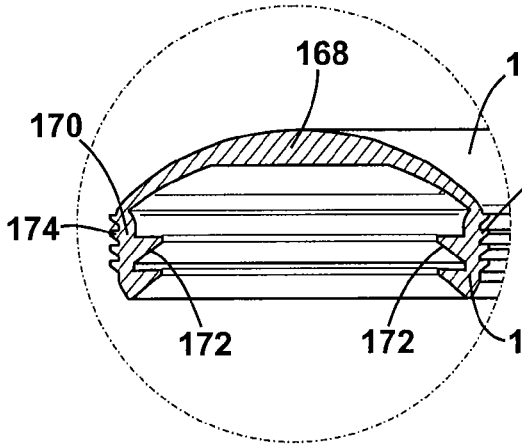
FIG. 6 is an enlarged view of a part of FIG. 5.

An annular seal 166 is attached to the closure member 150. The annular seal 166 is shown in more detail in FIGS. 4 to 6. In these figures, the annular seal 166 is shown removed from the remainder of the cyclonic separating apparatus 100. The annular seal 166 has a convex upper surface 168 and two side walls 170 which depend therefrom. The annular seal 166 is manufactured from a flexible material such as a rubber.

The convex upper surface 168 has an increased thickness towards the uppermost portion thereof. The side walls 170 have a sawtooth profile on both an internal surface 172 and an external surface 174 thereof. This is shown most clearly in FIG. 6. On the internal surfaces 172, the sawtooth profile comprises two teeth which define two circumferential grooves around the internal surfaces 172 of the side walls 170. The sawtooth profile on the external surfaces 174 comprises four smaller teeth which define four circumferential grooves around the external surfaces 174.

Figure 7:
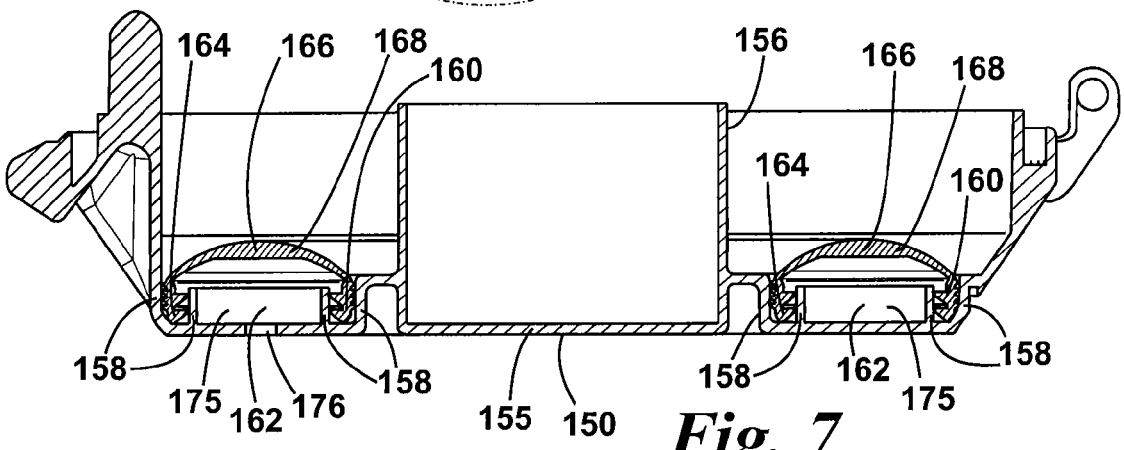
FIG. 7 is a side section of a closure member forming part of the cyclonic separating apparatus of FIG. 3.

FIG. 7 shows a cross-section of the closure member 150 with the annular seal 166 attached thereto. Each side wall 170 of the annular seal 166 is located in a respective relatively narrow annular channel 160, 164 of the closure member 150. The annular seal 166 is held in place by the engagement of the teeth located on the inner and outer surfaces 172, 174 of the side walls 170 of the annular seal 166 with the annular walls 158 of the closure member 150. As a result, the upper surface 168 of the annular seal 166 covers the relatively wide annular channel 162 of the closure member 150 to define a cavity 175.

A plurality of through-holes 176 (although only one is shown in FIG. 7) are formed in the base 155 of the closure member 150 to provide a communication path between the cavity 175 and the external atmosphere. Therefore, the cavity 175 will remain at atmospheric pressure, irrespective of the pressure inside the cyclonic separating apparatus 100. However, due to the speed of the airflow within the cyclonic separating apparatus 100, the pressure within the cyclonic separating apparatus 100 will be below atmospheric, resulting in a pressure drop across the upper surface 168 of the annular seal 166. Due to its flexible nature, the annular seal 166 will change shape depending upon the magnitude of the pressure difference established across the convex upper surface 168 thereof. In other words, the annular seal 166 is an expandable seal as it is able to expand, or inflate, when there is a positive pressure in the cavity relative to that within the cyclonic separating apparatus 100. However, when the closure member 150 is closed (as shown in FIG. 3), the upper surface 168 of the annular seal 166 will be compressed by the ends of the cylindrical walls 132, 146 to effect a seal between closure member 150 and the three collectors 106, 130, 144 even when there is no pressure drop across the upper surface 168 of the annular seal 166.

In use, the motor and fan unit draws a flow of dirt-laden air through the hose and wand, into the dirty air inlet 16, through the inlet 108 and into the cyclonic separating apparatus 100. Due to the tangential arrangement of the inlet 108, the airflow is forced to follow a helical path around the interior of the outer wall 102. Therefore, larger dirt and dust particles are separated by cyclonic motion in the first cyclonic separator 104. These particles are collected in the first collector 106.

The partially-cleaned airflow then flows back up the interior of the first cyclonic separator 104 and exits the first cyclonic separator 104 via the through-holes 114 in the shroud 110. Once the airflow has passed through the shroud 110, it enters the outlet 116 and from there enters the inlet 124 of the single cyclone 122 of the second cyclonic separator 118. The single cyclone 122 has a diameter smaller than the outer wall 102 of the first cyclonic separator 104 and is tapered. Therefore, the single cyclone 122 is able to separate smaller particles of dirt and dust from the partially-cleaned airflow than the first cyclonic separator 104. Separated dirt and dust exits the single cyclone 122 via the cone opening 128 and is collected in the second collector 130. The cleaned air then flows back up the centre of the single cyclone 122, exits the single cyclone 122 through the air outlet 126 and passes into the duct 134.

From duct 134, the airflow is then divided between the tangential air inlets 140 of the high-efficiency cyclones 138 of the third cyclonic separator 136. Each of the high-efficiency cyclones 138 has a diameter smaller than that of both the first cyclonic separator 104 and the single cyclone 122 of the second cyclonic separator 118. Therefore, the high-efficiency cyclones 138 are able to separate even finer particles of dirt and dust from the airflow than either of the first or second cyclonic separators 104, 118. Separated dirt and dust exits the high-efficiency cyclones 138 via the cone openings and passes into the third collector 144 where it is collected.

Cleaned air then flows back up the high-efficiency cyclones 138, exits the high-efficiency cyclones 138 through the air outlets 142 and enters the outlet 148. The cleaned air then passes from the outlet 148 sequentially through the pre-motor filter, the motor and fan unit, and the post-motor filter before being exhausted from the vacuum cleaner 10 through the air vents (not shown) located on the outer surface of the vacuum cleaner 10.

While the vacuum cleaner 10 is in use and the cyclonic separating apparatus 100 is operating, the speed of the airflow within the cyclonic separating apparatus 100 will be greater than the speed of the atmospheric air surrounding the vacuum cleaner 10. Therefore, the air pressure within the cyclonic separating apparatus 100 will be lower than atmospheric pressure. Consequently, there will be a pressure drop (or differential) across the convex upper surface 168 of the annular seal 166. The pressure in the cavity 175 beneath the annular seal 166 will be positive relative to the pressure in the cyclonic separating apparatus 100. This will cause the annular seal 166 to expand, or inflate. Due to the larger size of the annular seal 166 when compared to conventional arrangements, the annular seal 166 can then push upwards against the ends of the two cylindrical walls 132, 146. Therefore, a single annular seal 166 is able to seal effectively between the three separate collectors 106, 130, 144.

When a cleaning operation is finished, the collectors 106, 130, 144 of the cyclonic separating apparatus 100 may be full of dirt and dust, and require emptying. To do this, the user switches off the vacuum cleaner 10. When the vacuum cleaner 10 is switched off, the air pressure within the cyclonic separating apparatus 100 will return to atmospheric pressure. Therefore, there will be no pressure drop across the upper surface 168 of the annular seal 166 and so the annular seal 166 will contract, or deflate.

The user releases the cyclonic separating apparatus 100 from the main body 12 by pressing a release button (not shown), removes the cyclonic separating apparatus 100 from the remainder of the vacuum cleaner 10 and places it over a suitable receptacle such as a dustbin. The user then presses a further release button (not shown) in order to release the catch 154.

Figure 8:
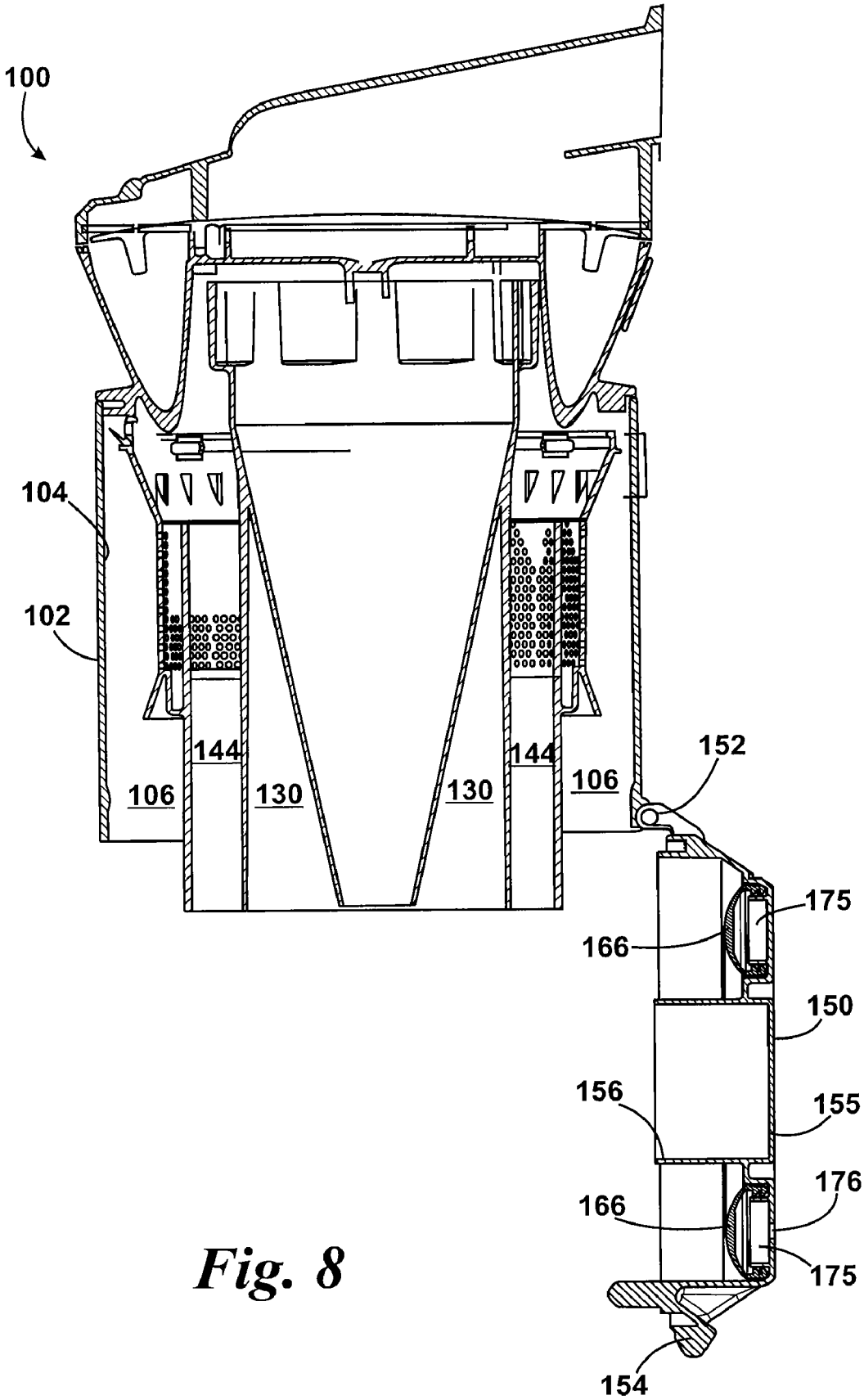
FIG. 8 is a side section of the cyclonic separating apparatus of FIG. 3, with the closure member in an open state.

This action releases the closure member 150, pushing the closure member 150 away from the wall 102 and allowing the closure member 150 to pivot downwardly about the hinge 152 as shown in FIG. 8. Since the annular seal 166 is deflated, the closure member 150 can be opened easily. The dirt and dust collected in the first, second and third collectors 106, 130, 144 can thus be emptied conveniently and efficiently. The first, second and third collectors 106, 130, 144 are emptied simultaneously during this process.

When the cyclonic separating apparatus 100 has been emptied as described above, the user manually moves the closure member 150 back into the closed position shown in FIG. 3. The annular seal 166 extends across the ends of the dividing walls 132, 146 of the three collectors 106, 130, 144 when the closure member 150 is in the closed position. Therefore, the surface area of the annular seal 166 available for sealing is relatively large. Consequently, even if the user does not close correctly the closure member 150 after emptying collected dirt and dust (such that the closure member 150 is misaligned slightly relative to the outer wall 102), then the annular seal 166 is still able to seal effectively against the dividing walls 132, 146.

The greater tolerance of misalignment between the closure member 150 and the outer wall 102 due to the annular seal 166 means that the sealing between the collectors 106, 130, 144 is more reliable. This leads to an improved efficiency of the cyclonic separating apparatus 100 and may potentially reduce the deposit of dirt and dust on parts of the vacuum cleaner 10 downstream of the cyclonic separating apparatus 100, for example, the pre-motor filter. In turn, this may reduce the number of times that the pre-motor filter has to be cleaned during the lifetime of the vacuum cleaner 10, reducing the effort required by the user to maintain the vacuum cleaner 10.

Once the closure member 150 has been returned to the closed position, the cyclonic separating apparatus 100 can then be replaced on the main body 12 of the vacuum cleaner 10 (as shown in FIGS. 1 and 2) for further cleaning operations.

The invention is not limited to the detailed description given above. Variations will be apparent to the person skilled in the art. For example, a part of the cyclonic separating apparatus other than the base may be movable for emptying purposes. Other forms, arrangements and locations of closure members may be used. For example, the side or top of the cyclonic separating apparatus may be movable (or openable). Further, the closure member need not be pivotable. Other opening arrangements for the closure member may be used; for example, sliding, retracting or rotating closure members.

The seal need not be expandable. A conventional, fixed seal could be used. Alternatively, other types of expandable seals may be used; the seal need not be expandable, or inflatable, in response to a pressure difference across a surface of the seal. For example, a seal which expands when heated may be used. Additionally, the seal need not be annular. Other arrangements, for example, square, rectangular or cylindrical shapes could be used. Alternatively, the seal could be in the form of a flexible sheet.

More or less than three cyclonic separators may be provided. For example, two cyclonic separators may be provided with one of the cyclonic separators having two collectors associated therewith. Any number of cyclones may be used in each cyclonic separator. For example, each cyclonic separator may have a single cyclone, or may have a plurality of cyclones. Additionally, more than three collectors may be provided.

The cleaning appliance need not be a cylinder vacuum cleaner. The invention is applicable to other types of vacuum cleaner, for example, upright machines, stick-vacuums or hand-held cleaners. Further, the present invention is applicable to other types of cleaning appliances, for example, a wet and dry machine or a carpet shampooer.

The invention claimed is:

1. A cyclonic separating apparatus for a cleaning appliance, comprising first, second and third cyclonic separators arranged in series for separating particles from a dirt- and dust-laden airflow, first, second and third collectors each for collecting dirt and dust separated from a respective cyclonic separator, a closure member movable between a closed position in which the closure member closes an end of each collector and an open position in which separated dirt and dust can be emptied from the collectors, the ends of the collectors being separated by dividing walls, and a common seal mounted on the base to seal between the closure member and each of the dividing walls when the closure member is in the closed position.

2. The cyclonic separating apparatus of claim 1, wherein the seal is located on the closure member.

3. The cyclonic separating apparatus of claim 1 or 2, wherein the seal is annular.

4. The cyclonic separating apparatus of claim 1 or 2, wherein the seal is in the form of a sheet.

5. The cyclonic separating apparatus of claim 1, wherein a wall of the first collector forms at least a part of an outer wall of the cyclonic separating apparatus and has an air inlet formed therein.

6. The cyclonic separating apparatus of claim 1, wherein the second collector is arranged inside the first collector.

7. The cyclonic separating apparatus of claim 1, wherein the third collector is arranged inside the first collector.

8. The cyclonic separating apparatus of claim 5, wherein the second collector is arranged inside the first collector.

9. The cyclonic separating apparatus of claim 5, wherein the third collector is arranged inside the first collector.

10. The cyclonic separating apparatus of claim 1, wherein the second collector is arranged inside the third collector.

11. The cyclonic separating apparatus of claim 1 or 2, wherein the collectors are substantially cylindrical and arranged concentrically with respect to one another.

12. The cyclonic separating apparatus of claim 1, wherein at least one of the second and third cyclonic separators comprises a plurality of cyclones in parallel.

13. A cleaning appliance comprising the cyclonic separating apparatus of claim 1 or 2.

14. A vacuum cleaner comprising the cleaning appliance of claim 13.

* * * * *